US009657940B2

(12) United States Patent
Kim

(10) Patent No.: US 9,657,940 B2
(45) Date of Patent: May 23, 2017

(54) PORTABLE BURNER

(71) Applicant: KOVEA CO., LTD., Bucheon-si (KR)

(72) Inventor: Sang Hyun Kim, Goyang-si (KR)

(73) Assignee: KOVEA CO., LTD., Bucheon-si (KR)

( * ) Notice: Subject to any disclaimer, the term of this patent is extended or adjusted under 35 U.S.C. 154(b) by 587 days.

(21) Appl. No.: 14/257,218

(22) Filed: Apr. 21, 2014

(65) Prior Publication Data

US 2014/0342294 A1 Nov. 20, 2014

(30) Foreign Application Priority Data

May 16, 2013 (KR) ..... 10-2013-0055864

(51) Int. Cl.
*F23D 5/12* (2006.01)
*F23D 14/28* (2006.01)
*F23D 14/46* (2006.01)

(52) U.S. Cl.
CPC ..... *F23D 5/12* (2013.01); *F23D 14/28* (2013.01); *F23D 14/46* (2013.01); *F23D 2212/00* (2013.01); *F23D 2213/00* (2013.01)

(58) Field of Classification Search
CPC ..... F23D 14/28
See application file for complete search history.

(56) References Cited

U.S. PATENT DOCUMENTS 2,482,797 A 9/1949 Quinnell et al.
2,784,580 A * 3/1957 Trow ..... F23D 91/02 362/179
4,201,537 A * 5/1980 Nitta ..... F23Q 2/42 220/501
5,009,592 A * 4/1991 Roldan ..... A45D 20/06 431/255
5,513,623 A 5/1996 Hong
5,927,537 A 7/1999 Falk et al.
6,089,218 A * 7/2000 Mifune ..... F17C 7/04 126/38
6,505,620 B1 * 1/2003 Goto ..... F24C 3/14 126/305
2005/0252023 A1 * 11/2005 Anthes ..... A45D 1/02 34/96

(Continued)

FOREIGN PATENT DOCUMENTS

CZ WO 2005071306 A1 * 8/2005 ..... F17C 1/16
GB 2483501 A * 3/2012 ..... F17C 3/00
JP 2004044816 2/2004

(Continued)

*Primary Examiner* — Kenneth Rinehart
*Assistant Examiner* — Logan Jones
(74) *Attorney, Agent, or Firm* — Cantor Colburn LLP

(57) ABSTRACT

A portable burner includes: a burner body having a burner head; and a fuel storage unit disposed below the burner body, and configured to supply fuel to the burner head, wherein the fuel storage unit includes an inner case configured to store fuel, and an outer case configured to accommodate the inner case therein, wherein at least part of the inner case and the outer case is formed to be transparent or semi-transparent, and wherein a shock absorber is formed between the inner case and the outer case. Under such configuration, a user can check the amount of fuel remaining in the fuel storage unit with the naked eye, and damage and transformation of the portable burner can be minimized.

11 Claims, 4 Drawing Sheets

(56) References Cited

U.S. PATENT DOCUMENTS

| | | | | |
|---|---|---|---|---|
| 2006/0172240 | A1* | 8/2006 | Yu | F23Q 2/287<br>431/255 |
| 2010/0116828 | A1* | 5/2010 | Takahashi | B23K 11/002<br>220/562 |

FOREIGN PATENT DOCUMENTS

| | | | | |
|---|---|---|---|---|
| JP | 2008261381 | | 10/2008 | |
| KR | 20070100622 | A * | 10/2007 | |
| NO | EP0958473 | A1 * | 11/1999 | F17C 1/02 |
| ZA | WO 2007060643 | A2 * | 5/2007 | F23D 14/28 |

* cited by examiner

PORTABLE BURNER

CROSS-REFERENCE TO RELATED APPLICATION

Pursuant to 35 U.S.C. §119(a), this application claims the benefit of earlier filing date and right of priority to Korean Application No. 10-2013-0055864, filed on May 16, 2013, the contents of which is incorporated by reference herein in its entirety.

BACKGROUND OF THE DISCLOSURE

1. Field of the Disclosure

The present disclosure relates to a portable burner, and particularly, to a portable burner capable of allowing a user to check fuel with the naked eye.

2. Background of the Disclosure

As camping activities increase recently, a portable burner for cooking is being much used.

Such portable burner is classified into a gas burner using gas, and an oil burner using oil. For this, the portable burner is additionally provided with a fuel storage unit for storing gas or oil.

Generally, the fuel storage unit is formed to be opaque. For instance, the fuel storage unit is formed of plastic, metal, etc. of an opaque color. This may cause a user to have a difficulty in viewing inside of the fuel storage unit with the naked eye.

In order to check the amount of fuel (gas or oil) remaining in the fuel storage unit while the portable burner is used, a user should separate the fuel storage unit from the portable burner. For a user's enhanced convenience, a portable burner, capable of checking the amount of fuel remaining in the fuel storage unit with the naked eye, is required.

SUMMARY OF THE DISCLOSURE

Therefore, an aspect of the detailed description is to provide a portable burner capable of checking the amount of fuel remaining in a fuel storage unit with the naked eye.

Another aspect of the detailed description is to provide a portable burner capable of having minimized damage and transformation.

To achieve these and other advantages and in accordance with the purpose of this specification, as embodied and broadly described herein, there is provided a portable burner, comprising: a burner body including a burner head; and a fuel storage unit disposed below the burner body, and configured to supply fuel to the burner head, wherein the fuel storage unit includes an inner case configured to store fuel, and an outer case configured to accommodate the inner case therein, wherein at least part of the inner case and the outer case is formed to be transparent or semi-transparent, and wherein a shock absorber is formed between the inner case and the outer case.

Under such configuration, a user can check the amount of fuel remaining in the fuel storage unit with the naked eye, and damage and transformation of the portable burner can be minimized.

The present invention can have the following advantages.

Firstly, as the fuel storage unit for supplying fuel to the burner head is formed to be transparent or semi-transparent, the amount of fuel remaining in the fuel storage unit can be easily checked while the portable burner is used.

Secondly, as the shock absorber is formed between the inner case and the outer case of the fuel storage unit, an impact applied to the portable burner from outside can be buffered. This can prevent damage and transformation of the fuel storage unit.

Further scope of applicability of the present application will become more apparent from the detailed description given hereinafter. However, it should be understood that the detailed description and specific examples, while indicating preferred embodiments of the disclosure, are given by way of illustration only, since various changes and modifications within the spirit and scope of the disclosure will become apparent to those skilled in the art from the detailed description.

BRIEF DESCRIPTION OF THE DRAWINGS

The accompanying drawings, which are included to provide a further understanding of the disclosure and are incorporated in and constitute a part of this specification, illustrate exemplary embodiments and together with the description serve to explain the principles of the disclosure.

In the drawings.

DETAILED DESCRIPTION OF THE DISCLOSURE

Description will now be given in detail of the exemplary embodiments, with reference to the accompanying drawings. For the sake of brief description with reference to the drawings, the same or equivalent components will be provided with the same reference numbers, and description thereof will not be repeated.

Hereinafter, a preferred embodiment of the present invention will be explained in more detail with reference to FIGS. 1 to 4.

Figure 1:
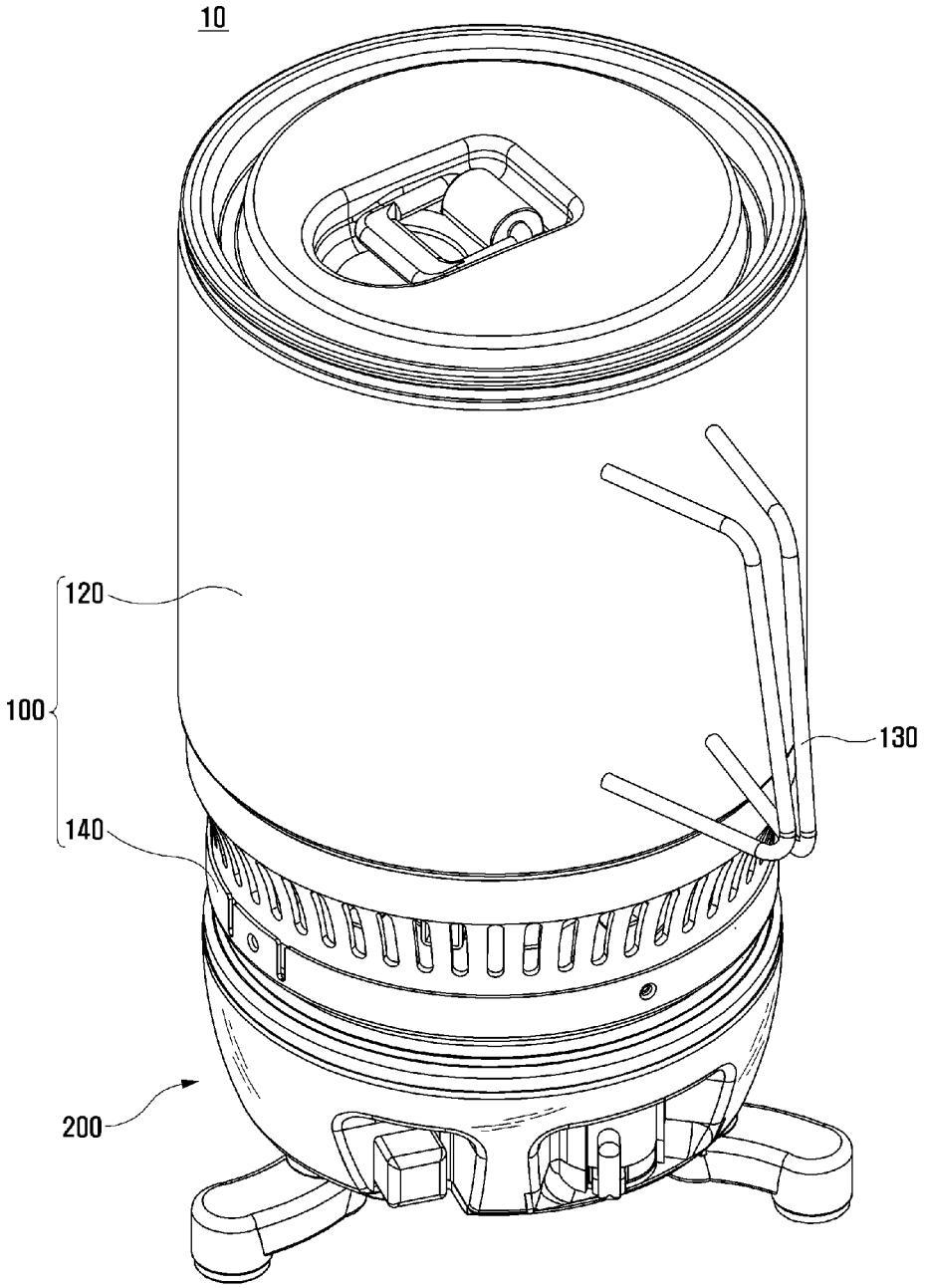
FIG. 1 is a perspective view of a portable burner according to an embodiment of the present invention.
Figure 2:
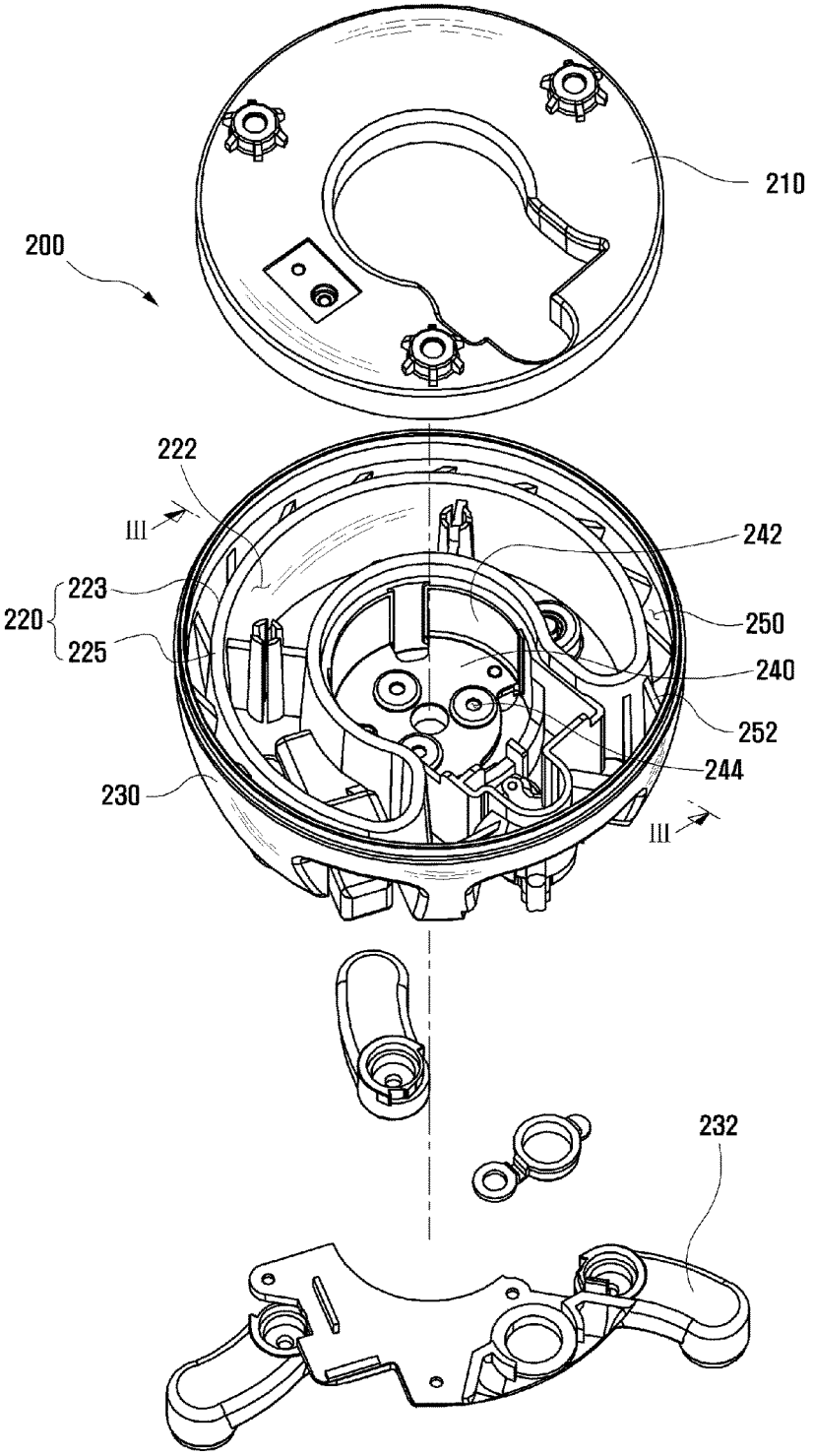
FIG. 2 is a perspective view of a fuel storage unit of FIG. 1.
Figure 3:
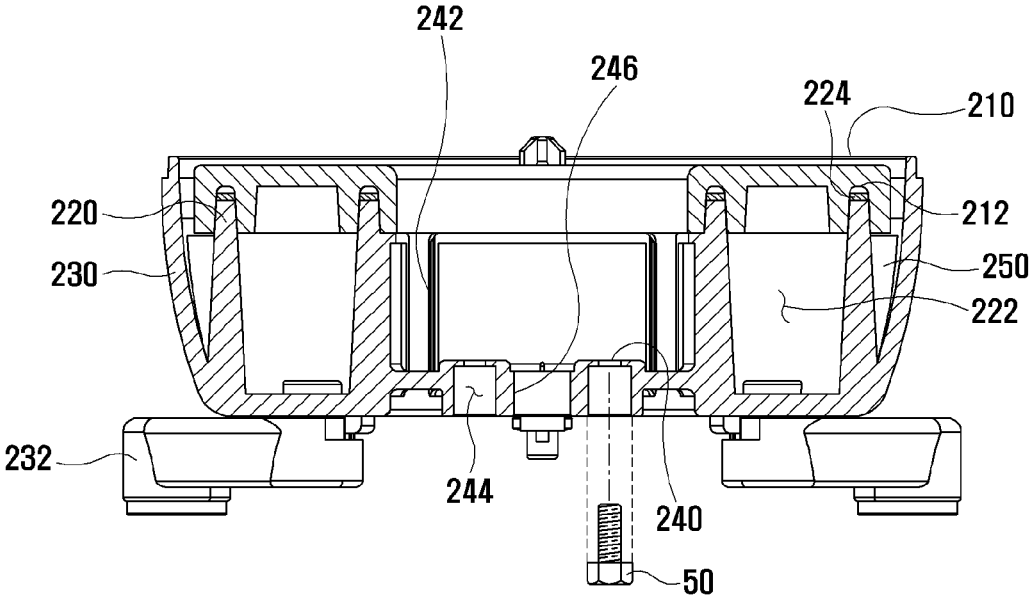
FIG. 3 is a sectional view taken along line 'III-III' in FIG. 2.
Figure 4:
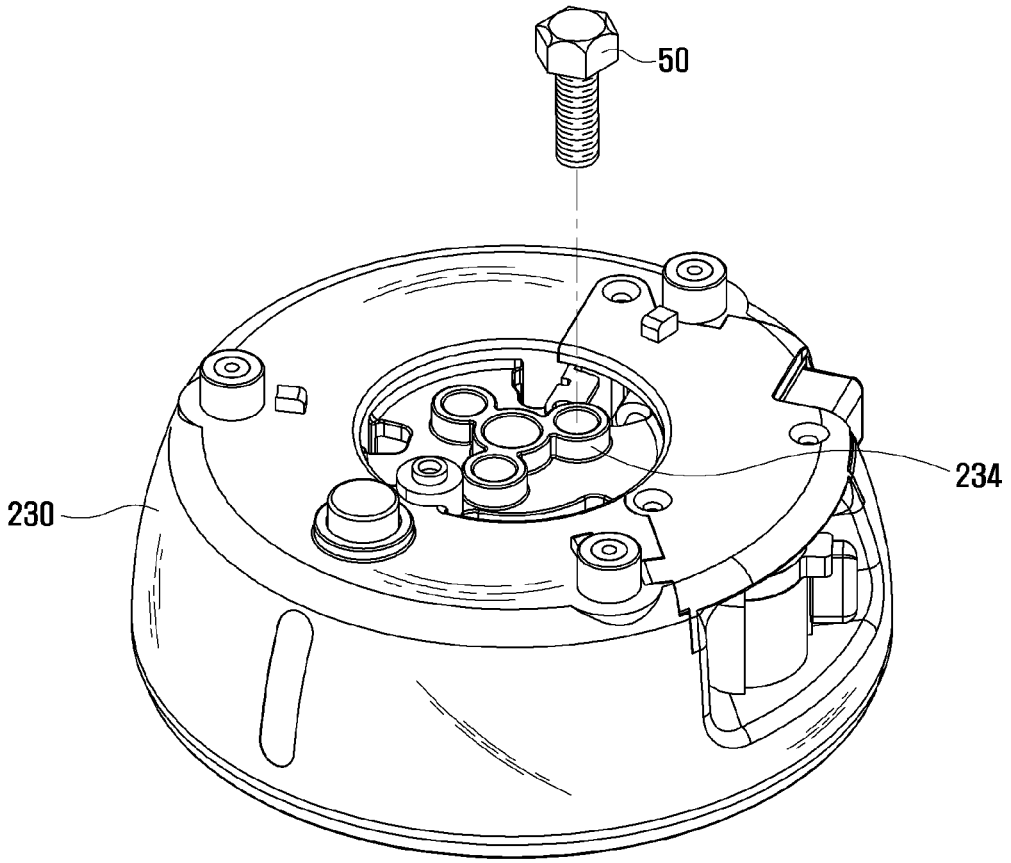
FIG. 4 is a perspective view illustrating a rear surface of the fuel storage unit of FIG. 2.

FIG. 1 is a perspective view of a portable burner according to an embodiment of the present invention, FIG. 2 is a perspective view of a fuel storage unit of FIG. 1, FIG. 3 is a sectional view taken along line 'III-III' in FIG. 2, and FIG. 4 is a perspective view illustrating a rear surface of the fuel storage unit of FIG. 2.

Referring to FIGS. 1 to 4, a portable burner 10 according to an embodiment of the present invention includes a burner body 100 including a burner head 140; and a fuel storage unit 200 disposed below the burner body 100, and configured to supply fuel to the burner head 140.

The burner body 100 further includes a food storage unit 120 configured to store food items therein. Alternatively, the burner body 100 may further include the food storage unit 120, and a handle 130 configured to facilitate usage of the food storage unit 120 and to separate the food storage unit 120 from the burner head 140.

The fuel storage unit 200 is a member configured to store fuel so as to supply the fuel to the burner head 140. The fuel storage unit 200 includes an inner case 220 configured to store fuel, and an outer case 230 configured to accommodate the inner case 220 therein. At least part of the inner case 220 and the outer case 230 is formed to be transparent or semi-transparent. A shock absorber 250 may be formed between the inner case 220 and the outer case 230.

More specifically, the outer case 230 may implement an appearance of the fuel storage unit 200, and may be formed to have the same shape and size as the burner head 140. A supporting member 232, configured to support the fuel storage unit 200, may be further formed at the outer case 230. The supporting member 232 may be integrally formed with the outer case 230.

A storage groove 222 configured to store fuel therein may be formed at the inner case 220. The storage groove 222 may be formed in a doughnut shape that two ends are separated from each other. The reason is as follows. A screw coupling unit 240 formed of a metallic material, which is to be explained later, may be mounted to a central region of the inner case 220. The screw coupling unit 240 may increase thermal diffusion of the fuel stored in the inner case 220.

The fuel stored in the inner case 220 may be either oil or gas. Hereinafter, the present invention will be explained under an assumption that gas is stored in the inner case 220 as fuel. However, the present invention is not limited by a type of the fuel stored in the inner case 220.

The inner case 220 and the outer case 230 may be formed to be transparent or semi-transparent. For instance, the inner case 220 and the outer case 230 may be formed of a transparent plastic material, silicone, silicone rubber, etc. A user can check a decreased degree of fuel by checking the amount of the fuel stored in the inner case 220 with the naked eye. This can allow fuel to be filled or the fuel storage unit 200 to be replaced more easily, according to the remaining amount of the fuel.

The inner case 220 and the outer case 230 may be formed to be distant from each other by a prescribed gap by the shock absorber 250. The reason is as follows. When the fuel stored in the inner case 220 is heated, temperature of the inner case 220 is increased. The increased temperature may be transmitted to the outer case 230, which may cause the outer case 230 to be damaged or transformed. In order to solve such damage of the outer case 230, the inner case 220 and the outer case 230 are formed to be distant from each other by a prescribed gap. Under such configuration, high temperature, generated when the fuel stored in the inner case 220 is heated, can be prevented from being directly transmitted to the outer case 230. As a result, damage and transformation of the outer case 230 can be prevented.

The shock absorber 250 includes a plurality of ribs 252 between the inner case 220 and the outer case 230. The ribs 252 may be formed at a gap between the inner case 220 and the outer case 230. The ribs 252 serve to buffer an impact applied to the portable burner 10. The portable burner 10, which is frequently used outdoors, may be easily damaged by external shocks. However, the portable burner 10 can be prevented from being damaged, because the ribs 252 buffers an impact applied to the portable burner 10.

The ribs 252 may increase a buffer force by being arranged in the form of an oblique line. For instance, the ribs 252 may be formed to be inclined in a clockwise direction. However, the present invention is not limited to this. That is, the ribs 252 may be formed to be inclined in a counter-clockwise direction.

The fuel storage unit 200 will be explained in more detail. The inner case 220 may be formed in a doughnut shape that two ends are separated from each other. The reason is because a lower end of the burner head 140 is mounted to the inner case 220 along the periphery of the storage groove 222. The inner case 220 further includes a screw coupling unit 240 formed of a metallic material. The screw coupling unit 240 has screw openings 244 for coupling a plurality of screws 50 thereto, so that the burner head 140 of which lower end has been mounted to the inner case 220 can be supported. The screw coupling unit 240 may be formed to enclose an end portion of the screws 50 having been inserted into the screw openings 244, thereby preventing the screws 50 from directly contacting the inner case 220 when the portable burner 20 is operated.

The screw openings 244 may be penetratingly-formed at the outer case 230 and the inner case 220, so that the outer case 230 and the inner case 220 can be simultaneously assembled to each other by the screws 50 having been inserted into the screw openings 244.

The screw coupling unit 240 further includes an extension plate 242 extending from an end portion of the screw coupling unit 240 toward a side wall of the inner case 220, and configured to accelerate combustion of the fuel stored in the inner case 220. That is, the screw coupling unit 240 and the extension plate 242 may prevent melting of the burner head 140 and the inner case 220, the melting resulting from that the fuel stored in the inner case 220 is heated due to direct contact between the inner case 220 and the burner head 140. When the fuel stored in the inner case 220 is heated, evaporation of the fuel stored in the inner case 220 may be accelerated because the screw coupling unit 240 and the extension plate 242 have temperature increase.

The outer case 230 may further include screw insertion openings 234 formed to enclose the screws 50 coupled to the screw openings 244, and extending from the outer case 230. The screw insertion openings 234 are formed to have a diameter larger than that of the screw openings 244, so as not to contact an outer side surface of the screws 50.

The screw insertion openings 234, insertion holes for inserting the screws 50, are formed to have a diameter larger than that of the screws 50. Under such configuration, adhesion of the screws 50 to the outer case 230 and the inner case 220 can be prevented, the adhesion resulting from that the case melts due to high temperature while the portable burner 10 is operated.

The inner case 220 further includes an inner case body 223 having an open upper end 225, and a cover 210 configured to seal the upper end 225 of the inner case body 223. The cover 210 may be formed of a transparent or semi-transparent material. Preferably, the cover 210 may be formed of the same material as the inner case 220 and the outer case 230.

More specifically, the cover 210 includes a coupling groove 212 formed to enclose the upper end 225 of the inner case body 223. The coupling groove 212 is configured to seal the fuel stored in the inner case 220, as an upper end of the inner case 220 is fit-mounted thereto. The coupling groove 212 is formed to have a size smaller than that of the upper end of the inner case 220. Under such configuration, when fit-mounted to the coupling groove 212, the upper end of the inner case 220 is prevented from being separated from the coupling groove 212.

The upper end 225 of the inner case body 223 may be formed so that its thickness can be decreased toward the upper side. Under such configuration, the upper end 225 of the inner case body 223 can be easily coupled to the coupling groove 212, and a sealed degree between the upper end 225 of the inner case body 223 and the coupling groove 212 can be increased.

The cover 210 and the inner case body 223 may be welded to each other. More specifically, the cover 210 and a side surface of the inner case body 223 may be welded to each other by using ultrasonic waves. As the cover 210 and the side surface of the inner case body 223 are welded to each other, the fuel stored in the inner case 220 can be prevented from leaking out. Further, resistance to pressure applied to the inner case 220 can be enhanced when the fuel stored in the inner case 220 combusts.

That is, the inner case 220 further includes a packing member 224 adhered to the cover 210, at the upper end 225 of the inner case body 223. When the upper end of the inner case 220 is fit-coupled to the coupling groove 212, the packing member 224 may be adhered to the cover 210 to thus prevent the upper end of the inner case 220 from being separated from the coupling groove 212. If the side surface of the inner case body 223 and the cover 210 are welded to each other by using ultrasonic waves, the packing member 224 is pressed in the cover 210. Accordingly, an adhered degree between the cover 210 and the upper end 225 of the inner case body 223 is increased. As a result, the inner case 220 is further sealed so that the fuel stored in the inner case 220 can be prevented from leaking out.

As the cover 210 is positioned at the upper end 225 of the inner case body 223, the upper part of the inner case 220 is sealed so that leakage of fuel can be prevented. Further, as the side surface of the inner case body 223 and the cover 210 are welded to each other by using ultrasonic waves, a gap between the packing member 224 provided at the upper end 225 of the inner case body 223 and the cover 210 is pressed. As a result, the inner case 220 is secondarily sealed to thus additionally prevent leakage of fuel.

The packing member 224 is coupled to the coupling groove 212 before the inner case 223 and the cover 210 are welded to each other, thereby adhering the inner case body 223 and the cover 210 to each other. The packing member 224, formed of a rubber material, may be additionally mounted to the upper end of the inner case 220. Alternatively, the upper end of the inner case 220 may be formed to have a spherical shape, so that the upper end of the inner case 220 can serve as the packing member 224.

The fuel storage unit 200, which is mounted to the portable burner 10, is formed to be transparent or semi-transparent. Accordingly, while the portable burner 10 is operated, an increased or decreased degree of fuel can be checked with the naked eye. This can allow filling of fuel or replacement of the fuel storage unit 200, to be performed at a more appropriate time.

The foregoing embodiments and advantages are merely exemplary and are not to be considered as limiting the present disclosure. The present teachings can be readily applied to other types of apparatuses. This description is intended to be illustrative, and not to limit the scope of the claims. Many alternatives, modifications, and variations will be apparent to those skilled in the art. The features, structures, methods, and other characteristics of the exemplary embodiments described herein may be combined in various ways to obtain additional and/or alternative exemplary embodiments.

As the present features may be embodied in several forms without departing from the characteristics thereof, it should also be understood that the above-described embodiments are not limited by any of the details of the foregoing description, unless otherwise specified, but rather should be considered broadly within its scope as defined in the appended claims, and therefore all changes and modifications that fall within the metes and bounds of the claims, or equivalents of such metes and bounds are therefore intended to be embraced by the appended claims.

What is claimed is:

1. A portable burner, comprising:

a burner body including a burner head; and a fuel storage unit disposed below the burner body, and configured to supply fuel to the burner head, wherein the fuel storage unit includes:

an inner case configured to store fuel, wherein the inner case is formed in a doughnut shape that two ends are separated from each other;

an outer case configured to accommodate the inner case therein; and a screw coupling unit mounted to a central region of the inner case, formed of a metallic material, and having screw openings for coupling a plurality of screws thereto such that the burner head is supported, wherein at least part of the inner case and the outer case is formed to be transparent or semi-transparent, wherein a shock absorber is formed between the inner case and the outer case, and wherein the outer case includes screw insertion openings so as not to contact a side surface of the screws, the screw insertion openings formed to enclose the screws, communicated with the screw openings, and having a diameter larger than that of the screw openings.

2. The portable burner of claim 1, wherein the shock absorber includes a plurality of ribs formed between the inner case and the outer case.

3. The portable burner of claim 2, wherein the ribs are arranged in the form of an oblique line.

4. The portable burner of claim 1, wherein the screw coupling unit further includes an extension plate extending from an end portion of the screw coupling unit toward a side wall of the inner case, and configured to accelerate combustion of the fuel stored in the inner case.

5. The portable burner of claim 1, wherein the inner case further includes:

an inner case body having an open upper end; and a cover configured to seal the upper end of the inner case body.

6. The portable burner of claim 5, wherein the cover includes a coupling groove formed to enclose the upper end of the inner case body.

7. The portable burner of claim 6, wherein the inner case further includes a packing member mounted at the upper end of the inner case body, and configured to seal the coupling groove.

8. The portable burner of claim 6, wherein the upper end of the inner case body is formed such that its thickness is decreased toward an upper side.

9. The portable burner of claim 6, wherein the cover and the inner case body are welded to each other by using ultrasonic waves.

10. The portable burner of claim 7, wherein the cover and the inner case body are welded to each other by using ultrasonic waves.

11. The portable burner of claim 8, wherein the cover and the inner case body are welded to each other by using ultrasonic waves.

* * * * *